US006543394B2

(12) United States Patent
Tinney

(10) Patent No.: US 6,543,394 B2
(45) Date of Patent: Apr. 8, 2003

(54) FOUR-CYCLE FUEL-LUBRICATED INTERNAL COMBUSTION ENGINE

(75) Inventor: Joseph F. Tinney, Arvada, CO (US)

(73) Assignee: Science Applications International Corp., San Diego, CA (US)

( * ) Notice: Subject to any disclaimer, the term of this patent is extended or adjusted under 35 U.S.C. 154(b) by 65 days.

(21) Appl. No.: 09/825,327

(22) Filed: Apr. 3, 2001

(65) Prior Publication Data

US 2001/0015180 A1 Aug. 23, 2001

Related U.S. Application Data

(63) Continuation-in-part of application No. 08/931,246, filed on Sep. 16, 1997, now Pat. No. 6,209,508, which is a continuation of application No. 08/810,244, filed on Mar. 3, 1997, now abandoned.

(51) Int. Cl.[7] ..... F01M 9/04
(52) U.S. Cl. ..... 123/1 A; 123/196 S
(58) Field of Search ..... 123/196 A, 196 S, 123/73 AD, 1 A

(56) References Cited

U.S. PATENT DOCUMENTS

| | | | | | |
|---|---|---|---|---|---|
| 2,580,572 | A | * | 1/1952 | McMillan | 123/196 S |
| 4,095,571 | A | * | 6/1978 | Fleetwood et al. | 123/198 C |
| 4,417,561 | A | * | 11/1983 | Yasuhara | 123/196 R |
| 4,421,078 | A | * | 12/1983 | Hurner | 123/1 A |
| 4,615,305 | A | * | 10/1986 | Matsumoto | 123/196 R |
| 4,674,456 | A | * | 6/1987 | Merritt | 123/196 R |
| 4,730,580 | A | * | 3/1988 | Matsushita | 123/196 R |
| 4,869,346 | A | * | 9/1989 | Nelson | 123/196 S |
| 5,238,712 | A | * | 8/1993 | Smith et al. | 134/22.19 |
| 5,353,760 | A | * | 10/1994 | Zager | 123/196 A |
| 5,390,762 | A | * | 2/1995 | Nelson | 123/196 S |
| 5,431,138 | A | * | 7/1995 | Hurner | 123/196 A |
| 5,476,073 | A | * | 12/1995 | Betts | 123/1 A |
| 5,720,249 | A | * | 2/1998 | Betts et al. | 123/196 S |
| 6,209,508 | B1 | * | 4/2001 | Tinney | 123/196 A |
| 6,213,080 | B1 | * | 4/2001 | Marsh et al. | 123/196 R |

OTHER PUBLICATIONS

"Super Hard Steels," fact sheet, Idaho Nat'l Engineering & Environmental Laboratory, USDEP.

"Applied Research—Research on Diamond–like and Nanograin Coatings," http://beam.helsinki.fi/programme/new-materials.html.

"Diamond–like Coatings," http://www.industrialtechnology.co.uk/diamond.htm.

"Lubricants—engine and its oil," http://auto.indiamart.com/auto–consumables/lubricants–engine–oil.html.

"The Engine Oil Bible," http://www.geocities.com/chrislonghurst/engineoil_bible.html.

Oja, "Nanocrystalline Diamond Thin Films," http://www.eng.rpi.edu/dept/materials/COURSES/NANO/oja/.

"Super–hard material thickly coats metals, plastics; also stands alone." http://www.sandia.gov/media/diamond.htm.

* cited by examiner

*Primary Examiner*—Erick Solis
(74) *Attorney, Agent, or Firm*—Banner & Witcoff, LTD

(57) ABSTRACT

A four-cycle, fuel lubricated, internal combustion engine system suited for a vehicle includes a fuel tank containing fuel at a remote location from the engine, a first fluid path for transporting fuel to the lubrication system of the engine, and a second fluid path for transporting fuel to said combustion system of the engine. In this way, the engine's fuel serves as the lubricant and the combustive agent. Certain load bearing surfaces of the engine can include a hard material based on borides, carbides and nitrides, a superhard steel, a self-lubricating material, or a diamond-like coating. The fuel can be one of liquefied petroleum gas, bio-diesel, natural gas, biogas, methanol, Fischer-Tropsch fuel, ethanol, n-pentene, hexane, n-heptane, isooctane, or hydrogen. Also, additives such as molybdenum disulfide, graphite, soybean derived oil, canola oil, polytetrafloeraethylene (PTFE), zinc dialkyldithiophosphate, polyalphaolefin, dibasic organic esters, or mineral oil can be added to the fuel.

37 Claims, 4 Drawing Sheets

FOUR-CYCLE FUEL-LUBRICATED INTERNAL COMBUSTION ENGINE

CROSS REFERENCE TO RELATED APPLICATIONS

This application is a continuation-in-part of application Ser. No. 08/931,246, filed on Sep. 16, 1997 now U.S. Pat. No. 6,209,508, which is a continuation of application Ser. No. 08/810,244, filed on Mar. 3, 1997, now abandoned.

FIELD OF THE INVENTION

The present invention relates to a four-cycle, internal combustion engine.

BACKGROUND OF THE INVENTION

In a conventional four-cycle internal combustion engine, the fuel and lubricating systems are maintained completely separate. Despite wide use, this division in the modern engine entails a number of shortcomings. For example, the oil is relied upon to not only reduce friction and wear, but also to serve as a coolant, an oxidation and corrosion inhibitor, and a transport fluid that removes wear metal particles and blow-by products (e.g., carbon, sludge, varnish, unburned fuel, and other combustion products) for subsequent filtration. Due to these requirements on the oil, the engine oil additives become depleted and the important characteristics of the lubricant are degraded. As a result, the oil over time will tend to experience an increase in viscosity and an accumulation of abrasive particles and oxides which, in turn, leads to the corrosion of engine components and increased wear. Moreover, replacement of the oil creates an added expense and a disposal problem with regard to the used oil. Finally, vehicles which are old or poorly maintained can experience considerable burning of the oil which leads to tailpipe emission problems.

A few engine systems have mixed oil and fuel together to facilitate oil replacement while the engine is in use. For instance, U.S. Pat. Nos. 5,431,138, 4,421,078, 4,869,346 and 4,495,909 disclose systems which pump a quantity of used oil into a fuel return line as the engine operates. Fresh oil in predetermined batches is also fed into the lubricating system to offset the oil which is removed. However, the maintenance of two fluid systems is still required. Moreover, as discussed above, the burning of oil creates undesirable pollution problems.

U.S. Pat. Nos. 4,572,120 and 4,615,305 to Matsumoto each discloses an outboard motor provided with a lubricant delivery tank mounted on the motor, and a storage tank which is mounted in the hull and fluidly coupled to the delivery tank. A pump feeds the lubricant in the delivery tank into the intake manifold of the motor. However, the outboard motor is a two-cycle engine, rather than a four-cycle engine. Moreover, this system requires the maintenance of separate oil and fuel systems and involves the burning of oil in the motor.

Other two-cycle, internal combustion engines have been produced which use an oil-fuel mixture for both lubrication and powering of the motor. However, these two-cycle engines are much different than modern four-cycle, internal combustion engines. For instance, these engines lack valves, rely upon oil-rich mixtures, and are very dirty engines which are not suitable for the high pollution standards now in existence for vehicles and other large engine applications.

Also, fuel lubrication is known to have advantages for an internal combustion engine, especially a diesel fuel engine.

As a result, most diesel fuels have high lubricity, or contain lubrous additives, to ensure that the fuel injector pump and fuel injectors are adequately lubricated during normal operation. However, no four-cycle, internal combustion engine has been used in which the fuel serves as the lubricant for the engine.

SUMMARY OF THE INVENTION

A primary object of the present invention is to provide a four-cycle, internal combustion engine in which the engine's fuel serves as the lubricant and the combustive agent.

A further object of the present invention is to provide a fuel lubricated, four-cycle, internal combustion engine which has a system for maintaining a desired quantity of clean lubricant (fuel) in the lubrication system.

These as well as other objects are accomplished by an engine system which comprises a fuel tank containing fuel at a remote location from the engine, a first fuel path to convey fuel to the lubricating system of the engine, and a second fuel path to convey fuel to the engine for combustion. In one preferred construction, the fuel is first directed into the lubricating system for lubricating the engine, and then to the combustion system for powering the engine.

In an alternative construction, the fuel tank is fluidly coupled to provide fresh fuel to both the lubricating system and the combustion system. A fuel return line is also provided to transport fuel used in the lubricating system to the fuel supply line for powering the engine with a mixture of fresh fuel and fuel used as a lubricant.

An engine in accordance with the present invention preferably operates with a high lubrous fuel, such as JP-8. Nevertheless, alternative fuels such as liquefied petroleum gas, bio-diesel, natural gas, biogas, methanol, Fischer-Tropsch fuel, ethanol, n-pentene, hexane, n-heptane, isooctane, or hydrogen can be used.

Additives such as molybdenum disulfide ($MoS_2$), graphite, soybean derived oils, canola oil, mineral oil, polytetrafloeraethylene (PTFE), zinc dialkyldithiophosphate, polyalphaolefin, and dibasic organic esters may also be added to the fuel to improve lubricity and/or clean engine components.

Advanced materials may also be used for certain engine components, thereby allowing the engine to operate with lower lubricity fuels. Such advanced materials include hard materials and coatings based on borides, carbides and nitrides, super-hard steels, self-lubricating materials, and diamond-like coatings.

By using a single fluid to power and lubricate an engine, the expense of maintaining two separate systems is eliminated. Since the lubricating fluid is constantly removed and replaced with fresh fuel, oil changing and disposal problems are eliminated. The constant exchange of fuel in the lubricating system also keeps contaminants in the lubricant to a low level which permits the elimination of an oil filter. Moreover, in view of the constant turn over of lubricant in the lubricating system and the low level of contaminants, the lubricant is not subject to undue degradation. Finally, the undesired exhaust produced from burning oil is completely obviated in the present system.

DETAILED DESCRIPTION OF THE PREFERRED EMBODIMENTS

The present invention pertains to a four-cycle, internal combustion engine that is lubricated by the fuel. The inventive system is best suited for a diesel engine, but could also be used in gasoline or alternative fuel powered, four-cycle, internal combustion engines.

Figure 1:
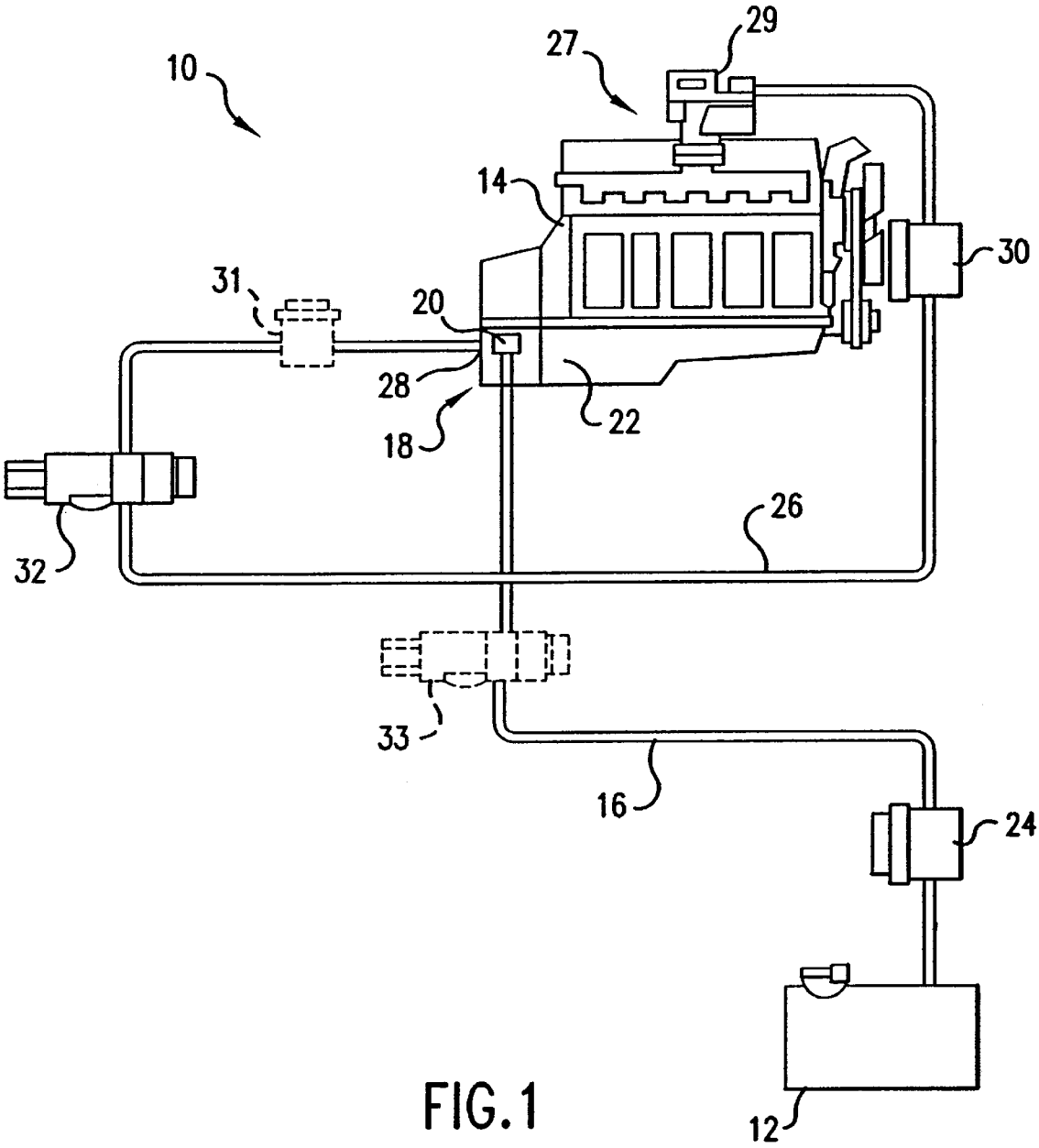
FIG. 1 is a schematic view of an engine system of a preferred embodiment of the present invention.

In the preferred embodiment, the present engine system 10 (FIG. 1) includes a fuel tank 12 which contains fuel at a location that is remote from a four-cycle, internal combustion, diesel engine 14. A diesel fuel, such as JP-8 (a fuel commonly used in military vehicles) or a fuel of similar lubricity can be used in an engine manufactured in accordance with the present invention. It is believed that a fuel having a viscosity in the range of about 1.5 to 4.5 centistokes would be suitable for use in the present invention. However, any fuel for an internal combustion engine which has sufficient lubricity to enable its use in the lubrication system of a four-cycle, internal combustion engine could be used in the present system.

Suitable alternative fuels include liquefied petroleum gases (primarily propane and butane), bio-diesel, natural gas, biogas, methanol, Fischer-Tropsch fuel, ethanol, npentene, hexane, n-heptane, isooctane, and hydrogen. A bio-diesel fuel (manufactured using, for example, soybeans) is one particularly advantageous alternative because it generally has a relatively high lubricity that approaches or exceeds that of JP-8 diesel.

While many of the alternative fuels including liquefied petroleum gas, natural gas, methanol, ethanol, and hydrogen have had limited use in internal combustion engines, none have been used in such engines as a combustive agent and a lubricant. Through the use of the present invention, such alternative fuels can now be utilized in both the combustion system and the lubrication system of a four-cycle internal combustion engine.

Further, the operation of the engine may be enhanced through the addition of additives to either the preferred JP-8 fuel or an alternative fuel. Specifically, the fuel may contain petroleum and/or non-petroleum based additives to improve lubricity and/or clean engine components. Suitable lubricants include molybdenum disulfide ($MoS_2$), graphite, soybean derived oils, canola oil, and mineral oil. The mineral oil may contain kerosene, naphthalene, xylene and/or acetone to provide the fuel with an enhanced capacity to maintain cleaner engine components. Further, some lubricants that have been used in conjunction with conventional engine oil may also be added to the fuel in the present invention for enhanced performance (e.g., increased lubricity). Such additives include polytetrafloeraethylene (PTFE), zinc dialkyldithiophosphate, polyalphaolefin, and dibasic organic esters.

The utilization of fuels for both combustion and lubrication is also enhanced by the development of advanced materials for high load-bearing surfaces in the internal combustion engines. While the use of such advanced materials to form engine parts will improve the performance and/or durability of any engine in accordance with the present invention, it particularly provides enhanced performance for fuels with a lower level of lubricity. Moreover, the use of these advanced materials can enable the use of fuels that may not otherwise be useable in an engine of the present invention, e.g., fuels with viscosties lower than 1.5 centistokes.

These advanced materials may be used to form or coat engine components that are under high load and/or extreme wearing conditions such as the crankshaft, bearings, piston rod couplings, valves and valve train components, fuel injectors, fuel injector pumps, cylinder walls, pistons, and the like. Suitable advanced materials for the present invention include hard materials and coatings based on borides, carbides and nitrides, particularly silicon-nitrides and silicon-carbides. Silicon-nitrides have been known to operate without lubrication at rotational speeds up to 40,000 rpm and loads up to 7,000 Newtons without significant wear or abrasion.

Other such advanced materials include super-hard steels, self-lubricating materials (e.g., molybdenum disulfide impregnated metal), and diamond-like coatings. A super-hard steel, as used herein, refers to a steel having stabilized nanoscale composite microstructures (e.g., those steels having $10^{-9}$ m, as compared to $10^{-6}$ m for conventional steels). Such super-hard steels have yield strengths on the order of 725 kilopounds per square inch (ksi) and greater, and have a hardness of about 12–16 gigapascals (GPa). Diamond-like coatings, as used herein, refer to materials formed by chemical vapor deposition of carbon compounds to form a coating of amorphous diamond, diamond nodules and amorphous graphite, or amorphous graphite. Diamond-like coatings applied to steel surfaces, following laser ablation (75% 10–50 nm diamond nodules and 25% amorphous graphite), have been known to have a hardness of 80 GPa and a low coefficient of friction. In laboratory tests using a type 304 stainless steel substrate, a 3.1-micron thick diamond-like coating increased the lifetime of a component by a factor of over 500 against high impact wear. Similarly, a 1-micron thick diamond-like coating increased the lifetime of a component by a factor of 60 against low impact wear.

In a preferred construction, a first fuel line 16 fluidly connects fuel tank 12 to the lubrication system 18 of engine 14. Fuel line 16 is preferably coupled to an inlet port 20 formed in the lubricant pan 22. Lubricant pan 22 defines a reservoir of the fuel to be used in lubricating the engine. Fuel pump 24 is installed along fuel line 16 to pump the fuel from tank 12 to pan 22. A conventional lubrication pump (not shown) would be used to convey the fuel through the lubrication system.

A second fuel line 26 couples the lubrication system 18 to the combustion system 27 of engine 14 in order to transport fuel, for example, to a fuel injector 29. Fuel line 26 draws fuel from pan 22 via outlet port 28. The turbulence within pan 22 is generally sufficient to amply mix the fuel and prevent channeling whereby the fresh fuel would flow directly from inlet port 20 to outlet port 28. Nonetheless, fuel line 26 could alternatively be connected to the lubrication system 18 via a port located outside of pan 22. For instance, line 26 could connect to a port at a location where the conventional oil filter would ordinarily mount.

Since fresh fuel is continually circulated into and out of the lubrication system, fouling and degradation of the lubricant (i.e., fuel) is avoided. Moreover, the conventional lubricant filter can be eliminated. Nevertheless, if desired, a filter could still be included in the lubrication system for additional protection. A conventional fuel filter 30 is positioned in line 26 to remove contaminants. Although diesel fuel is normally suitable for direct use as an engine lubricant, a fuel filter in fuel line 37, downstream of fuel pump 51, could be used to remove contaminants from the fresh fuel to be used as a lubricant.

Pan 22 includes a fluid level sensor (not shown) which senses when the fuel reaches a predetermined lower level.

The sensor would be used to not only activate a warning light and/or gauge, but also to close valve 32 in fuel line 26 to prevent the removal of too much fuel from the lubrication system. A float valve (not shown) is also preferably included in pan 22 to regulate the flow of fuel into pan 22 through port 20. The float valve acts to close port 20 as the volume of fuel in pan 22 reaches a predetermined upper limit, and open the port as the level of fuel drops in the pan. Alternatively, an upper level sensor (not shown), similar to the low level sensor, can be used to sense a predetermined volume of fluid in pan 22 and electrically signal a valve 33 in line 16 to open and close as needed.

In accordance with engine system 10, fuel in tank 12 is pumped through fuel line 16 by pump 24 and transported to pan 22. Preferably a float valve associated with port 20 regulates the amount of fuel fed into pan 22. While a one-way valve could be provided in line 16 to prevent reverse flow of the fuel to the tank, the pressure produced by pump 24 is generally sufficient to prevent the flow of fluid out of pan 22 and into fuel line 16. A pump (not shown) is used to pump the fuel in pan 22 through the lubrication system 18. A second fuel line 26 is provided to transport fuel from pan 22 to the combustion system 27 of the engine as the sole source of fuel for powering the engine. The pressure in lubricating system 27 is generally suitable for transporting the fuel through line 26 if the line is coupled to the system outside of the pan, such as where the lubrication filter is ordinarily attached. Nevertheless, an additional fuel pump 31 is used to pump the fuel through line 26 when the fuel is drawn from pan 22. Valve 32 is generally open, unless the fuel in pan 22 reaches the predetermined lower limit.

Figure 2:
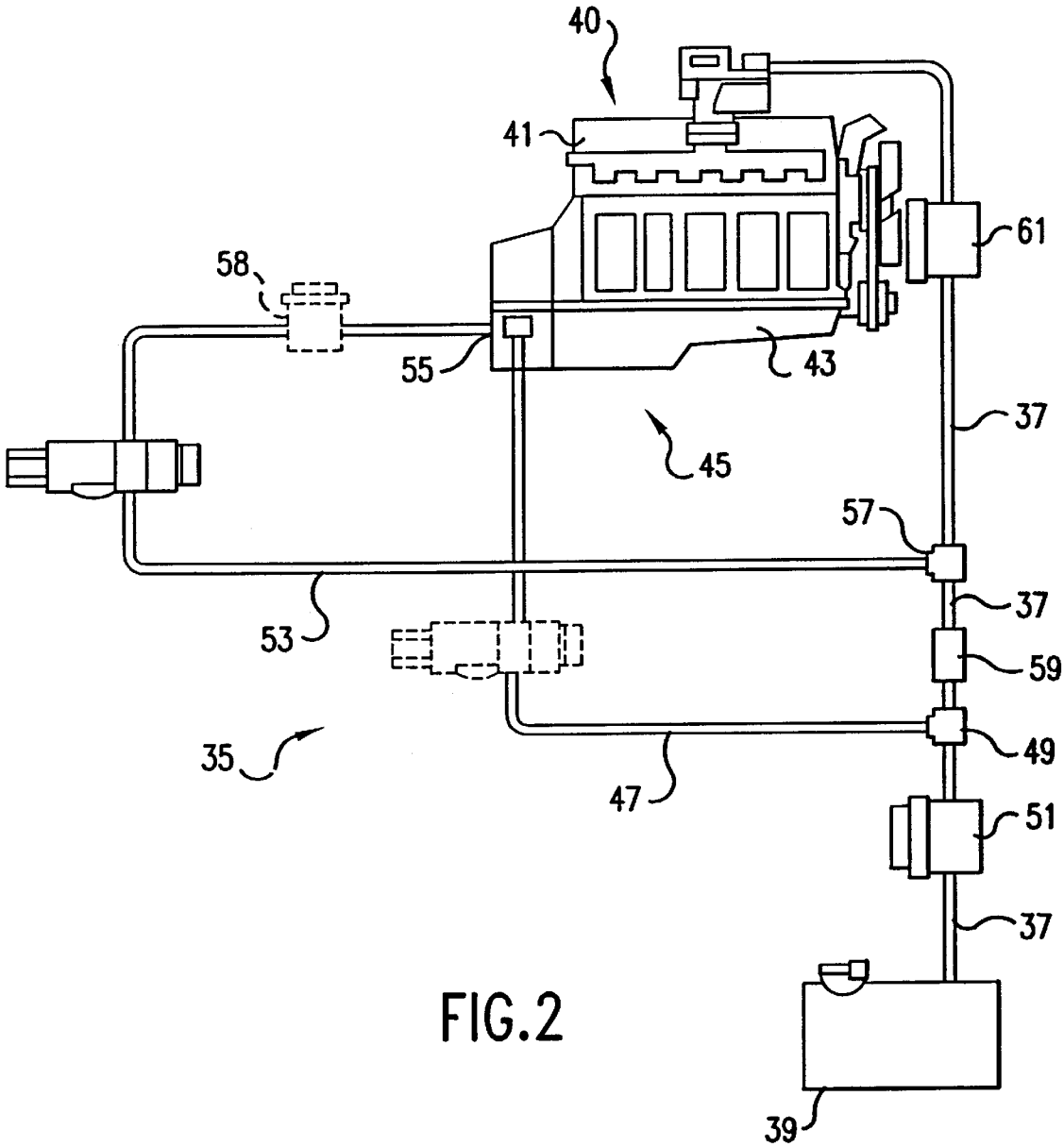
FIGS. 2 and 3 are alternative embodiments of an engine system.

In an alternative engine system 35 (FIG. 2), fuel line 37 transports fuel from fuel tank 39 to combustion system 40 of engine 41 to power the engine. A fuel or lubrication line 47 is joined to fuel supply line 37 by T-connector 49 to transport fresh fuel to the lubricant pan 43 in order to provide fuel to the lubrication system 45. A fuel pump 51 is installed along fuel line 37, upstream of T-connector 49, to pump the fuel through both lines 37 and 47. As an alternative, lubricant line 47 could be fluidly coupled to tank 39 independent of fuel supply line 37. However, this alternative construction would require an additional pump.

A fuel return line 53 is provided to transport fuel from lubrication system 45 to combustion system 40 of engine 41 in order to reuse the lubricating fuel for combustion. Fuel return line 53 is preferably coupled to lubricant pan 43, although other connections to the lubrication system could be made. More specifically, return line 53 draws fuel from pan 43 via port 55 and transports the fuel to supply line 37 via T-connector 57. A one-way valve 59 is provided in line 37, upstream of T-connector 57, to prevent a reverse flow of the fuel used as a lubricant to fuel tank 39. Preferably valve 59 is positioned between connectors 49 and 57 to also prevent recycling of the fuel in line 53 back to pan 43. Sensors and valves for regulating the volume of fuel in the lubricating system 45, as described above for engine system 10, would also be applicable to engine system 35. A fuel filter 61 in fuel line 37, downstream of T-connector 57, removes contaminants from the mixture of fresh fuel and the fuel used as a lubricant. A one-way valve (not shown) could optionally be provided in line 53 to prevent reverse flow of the fluid to pan 43, but is generally unnecessary due to the pressure in line 53. Pressure in line 53 is provided by a separate fuel pump 58, or, by the standard lubricant (oil) pump if exit port 55 is at the normal oil filter location.

Figure 3:
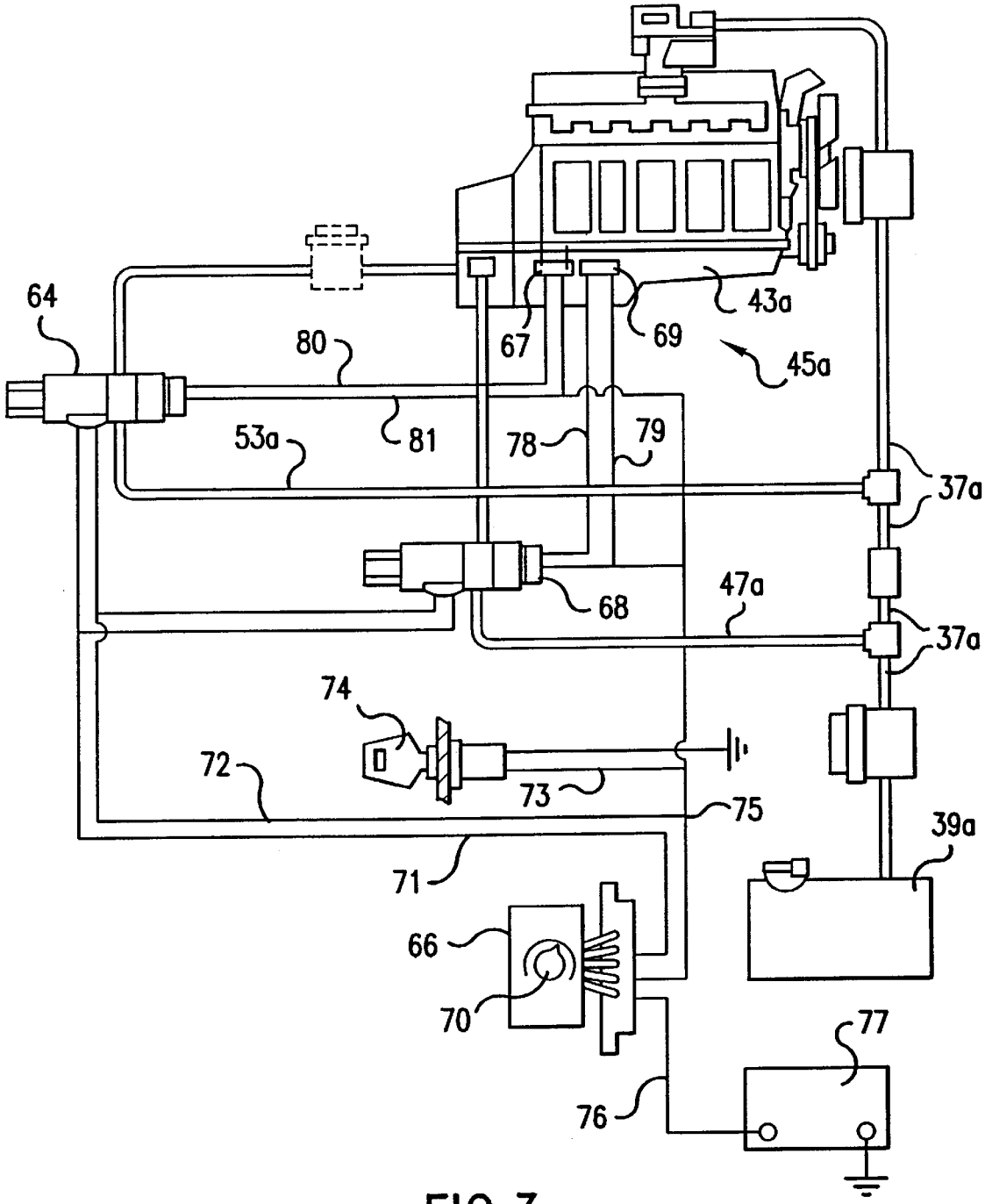

As another alternative (FIG. 3), a valve 64 is provided in return line 53*a* to regulate the flow of fuel from the lubricant pan 43*a* to the fuel supply line 37*a*. Valve 64 is opened intermittently based upon signals from a timer in control module 66. When valve 64 is open, the pressure generated by the lubricating pump (not shown) of the lubrication system 45*a* is sufficient to convey fuel through line 53*a* to mix with the fuel in supply line 37*a*. A valve 68 can also, optionally, be installed in lubrication line 47*a* in place of a float valve. In this arrangement, valve 68 is intermittently opened in response to a regular, periodic signal generated by control module 66. In this way, valve 68 thereby regulates the flow of fluid from the fuel tank 39*a* to the lubricant pan 43*a*.

In this alternative, control module 66 generates a regular, periodic signal at preset time intervals during engine operation to regulate the addition and removal of fuel to and from the engine lubrication system. An impulse timer within the control module 66 dictates the frequency at which a signal is generated. Varying frequencies can be selected by changing the position of a dial 70 located on the control module 66. Accordingly, valves 64 and 68 are intermittently operable in response to this signal during engine operation. The signals to valves 64 and 68 are provided through the electrical connection of the control module 66 with the valves. Specifically, leads 71 and 72 connect module 66 and valves 64, 68. A lead 73 runs from control module 66 to ignition switch 74 and is connected to a lead 72 from valves 64 and 68 at node 75. Lead 76 connects control module 66 to a constant power source 77, such as is readily available in a motor vehicle.

A low fluid sensor 67 is preferably provided in pan 43*a* to indicate when the fuel in pan has reached a predetermined low level. Sensor 67 is electrically coupled to control module 66 (or control valve 64) to override the periodic signal to open valve 64, and thereby prevents any further removal of fuel from the pan 43*a*. The operation of sensor 67 and valve 64 thus prevents emptying of fuel from the lubricating system as fuel in fuel tank 39*a* runs low. A second sensor 69 can also be provided in pan 43*a* to sense when the fuel reaches a predetermined upper limit. The activation of sensor 69 overrides control module 66 (or control valve 68) and prevents valve 68 from being opened and admitting additional fuel into pan 43*a*. Sensors 67, 69 are electrically, by leads 78–81, coupled to valves 64, 68 and control module 66.

Figure 4:
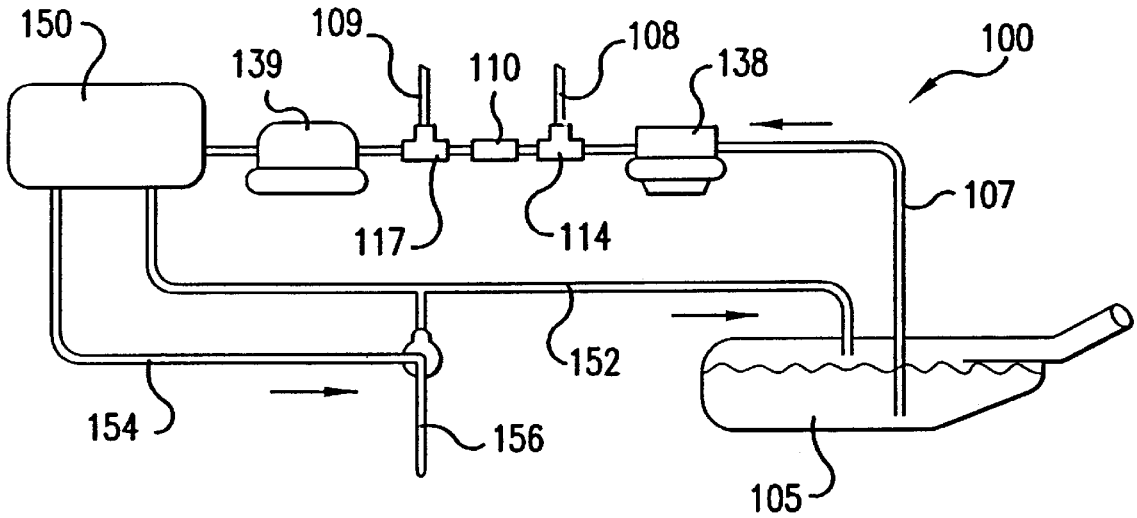
FIGS. 4 and 5 are schematic views of alternate fuel delivery systems.

The present invention may also be used in conjunction with other known engine systems. For example, a lubrication line 108 and return line 109 may be interconnected via connectors 114, 117 to a fuel supply line 107 in engine system 100 (FIG. 4). Engine system 100 includes a fuel tank 105, a fuel pump 138 and a fuel filter 139 located along line 107, and a fuel injection pump 150 located in the engine (not shown). A fuel return 152 extends from the fuel injector pump 150 to the fuel tank 105. An injection line 154 also extends from the injection pump 150 to an injection nozzle 156. As with the earlier systems, connectors 114, 117 are located between the fuel pump and the fuel filter. While a one-way valve 110 is preferably still provided between connectors 114, 117, it is not necessary. In this embodiment, fuel return line 152 permits fuel used as a lubricant to return to fuel tank 105.

Figure 5:
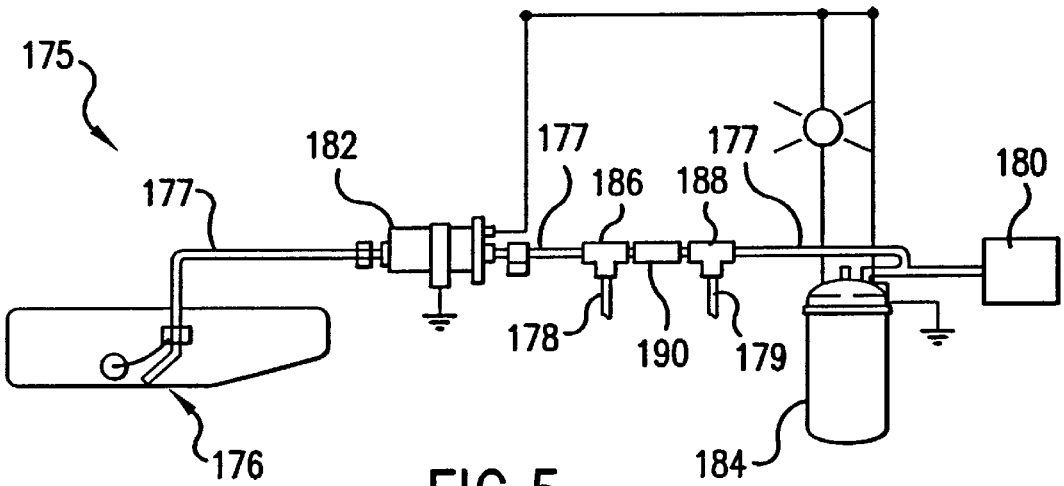

As a second example, the use of lubrication line 178 and return line 179 can be used with engine system 175 (FIG. 5). In this system, fuel supply line 177 extends between fuel tank 176 and injector pump 180. An electric solenoid pump 182 and a filter water separator/coalescer 184 are provided along fuel line 177. Connectors 186, 188 are provided downstream of pump 182 to couple lubrication and return lines 178, 179 to fuel supply line 177. One-way valve 190 is preferably provided between connectors 186 and 188 to prevent reverse flow of the fuel used as a lubricant to the fuel tank or to the lubrication system.

As the above description is merely exemplary in nature, being merely illustrative of the invention, many variations will become apparent to those of skill in the art. Such variations, however, are included within the spirit and scope of this invention as defined by the following appended claims.

What is claimed is:

1. An engine system comprising:

a four-cycle, internal combustion engine including a combustion system and a lubrication system;

a fuel tank for holding a reservoir of fuel, said fuel to be used as a combustive agent and a lubricant;

a first fluid path for transporting fuel to said lubrication system; and a second fluid path for transporting fuel to said combustion system;

wherein certain load bearing surfaces of said engine include one of (i) a hard material coating based on one of borides, carbides and nitrides, (ii) a super-hard steel, (iii) a self-lubricating material, and (iv) a diamond-like coating.

2. The engine system of claim 1, wherein at least one of the load bearing surfaces includes the hard material coating based on one of borides, carbides and nitrides.

3. The engine system of claim 2, wherein the hard material coating is one of silicon-nitride and silicon-carbide.

4. The engine system of claim 1, wherein at least one of the load bearing surfaces includes the self-lubricating material.

5. The engine system of claim 4, wherein the self-lubricating material is molybdenum disulfide impregnated metal.

6. The engine system of claim 1, wherein at least one of the load bearing surfaces includes the diamond-like coating.

7. The engine system of claim 6, wherein the diamond-like coating is a chemical vapor deposition of one of amorphous diamond, diamond nodules and amorphous graphite, and amorphous graphite.

8. The engine system of claim 1, further including a fuel in said fuel tank, said fuel being one of liquefied petroleum gas, bio-diesel, natural gas, biogas, methanol, Fischer-Tropsch fuel, ethanol, n-pentene, hexane, n-heptane, isooctane, and hydrogen.

9. The engine system of claim 1, further including a fuel in said tank and an additive in said fuel, said additive being at least one of molybdenum disulfide, graphite, soybean derived oil, canola oil, polytetrafloeraethylene (PTFE), zinc dialkyldithiophosphate, polyalphaolefin, dibasic organic esters, and mineral oil.

10. The engine system of claim 9, wherein the mineral oil includes one of kerosene, naphthalene, xylene and acetone.

11. An engine system comprising:

a four-cycle, internal combustion engine including a combustion system and a lubrication system;

a fuel tank for holding a reservoir of fuel, said fuel to be used as a combustive agent and a lubricant;

a first fluid path for transporting fuel to said lubrication system;

a second fluid path for transporting fuel to said combustion system;

a fuel in said fuel tank, said fuel being one of liquefied petroleum gas, bio-diesel, natural gas, biogas, methanol, Fischer-Tropsch fuel, ethanol, n-pentene, hexane, n-heptane, isooctane, and hydrogen; and an additive in said fuel, said additive being one of molybdenum disulfide, graphite, soybean derived oil, canola oil, polytetrafloeraethylene (PTFE), zinc dialkyldithiophosphate, polyalphaolefin, dibasic organic esters, and mineral oil.

12. The engine system of claim 11, wherein the fuel is liquefied petroleum gas.

13. The engine system of claim 11, wherein the fuel is bio-diesel.

14. The engine system of claim 11, wherein the fuel is natural gas.

15. The engine system of claim 11, wherein the fuel is biogas.

16. The engine system of claim 11, wherein the fuel is methanol.

17. The engine system of claim 11, wherein the fuel is Fischer-Tropsch fuel.

18. The engine system of claim 11, wherein the fuel is ethanol.

19. The engine system of claim 11, wherein the fuel is n-pentane.

20. The engine system of claim 11, wherein the fuel is hexane.

21. The engine system of claim 11, wherein the fuel is n-heptane.

22. The engine system of claim 11, wherein the fuel is isooctane.

23. The engine system of claim 11, wherein the fuel is hydrogen.

24. The engine system of claim 11, wherein the mineral oil includes one of kerosene, naphthalene, xylene and acetone.

25. An engine system comprising:

a four-cycle, internal combustion engine including a combustion system and a lubrication system;

a fuel tank for holding a reservoir of fuel, said fuel to be used as a combustive agent and a lubricant;

a first fluid path for transporting fuel to said lubrication system;

a second fluid path for transporting fuel to said combustion system; and a fuel in said fuel tank, the fuel having an additive including at least one of molybdenum disulfide, graphite, soybean derived oil, canola oil, polytetrafloeraethylene (PTFE), zinc dialkyldithiophosphate, polyalphaolefin, dibasic organic esters, and mineral oil.

26. The engine system of claim 25, wherein the fuel includes at least molybdenum disulfide as an additive.

27. The engine system of claim 25, wherein the fuel includes at least graphite as an additive.

28. The engine system of claim 25, wherein the fuel includes at least soybean derived oil as an additive.

29. The engine system of claim 25, wherein the fuel includes at least polytetrafloeraethylene (PTFE) as an additive.

30. The engine system of claim 25, wherein the fuel includes as least zinc dialkyldithiophosphate as an additive.

31. The engine system of claim 25, wherein the fuel includes at least polyalphaolefin as an additive.

32. The engine system of claim 25, wherein the fuel includes as least dibasic organic esters as an additive.

33. The engine system of claim 25, wherein the fuel includes at least mineral oil as an additive.

34. The engine system of claim 33, wherein the mineral oil includes one of kerosene, naphthalene, xylene and acetone.

35. A method of operating a four-cycle internal combustion engine having a lubrication system comprising the steps of:

holding a reservoir of fuel in a fuel tank, the fuel being one of liquefied petroleum gas, bio-diesel, natural gas, biogas, methanol, Fischer-Tropsch fuel, ethanol, n-pentene, hexane, n-heptane, isooctane, and hydrogen;

providing an additive in said fuel, said additive being at least one of molybdenum disulfide, graphite, soybean derived oil, canola oil, polytetrafloeraethylene (PTFE), zinc dialkyldithiophosphate, polyalphaolefin, dibasic organic esters, and mineral oil;

feeding said fuel to a lubrication system in said engine for lubricating said engine; and feeding said fuel to a combustion system in said engine for combustion.

36. The method of claim 35, wherein said feeding of said fuel to the combustion system includes feeding said fuel in the lubrication system to the combustion system.

37. The method of claim 35, wherein the mineral oil includes one of kerosene, naphthalene, xylene and acetone.

* * * * *